United States Patent [19]

Thomas et al.

[11] Patent Number: 4,820,073

[45] Date of Patent: Apr. 11, 1989

[54] DOCUMENT CARTRIDGE

[75] Inventors: Kent Thomas, Mayville; Daniel R. Bullis, Jr., Madison; Thomas J. Bottelson, Baraboo, all of Wis.

[73] Assignee: Tab Products Company, Palo Alto, Calif.

[21] Appl. No.: 153,344

[22] Filed: Feb. 8, 1988

[51] Int. Cl.[4] ..... B42F 13/12; B42F 3/04; B42F 13/20; B42F 15/00

[52] U.S. Cl. ..... 402/68; 402/30; 402/31; 312/184

[58] Field of Search ..... 402/4, 17, 20, 22, 30, 402/31, 38, 67, 68, 80 P, 80 R; 312/184, 185, 186, 187, 188; 24/573, 574, 575, 441, 442

[56] References Cited

U.S. PATENT DOCUMENTS

| | | | |
|---|---|---|---|
| 776,703 | 12/1904 | Turck | 402/30 |
| 1,571,905 | 2/1926 | Herman | 402/30 |
| 1,638,073 | 8/1927 | Van Heusen | 24/442 |
| 1,817,488 | 8/1931 | Irving | 402/31 |
| 3,801,175 | 4/1974 | Giulie | 312/184 |
| 4,646,497 | 3/1987 | Hoenle | 24/573 |
| 4,704,771 | 11/1987 | Orje | 24/574 |
| 4,718,739 | 1/1988 | Price et al. | 312/184 |

*Primary Examiner*—Frank T. Yost
*Assistant Examiner*—Paul M. Heyrana, Sr.
*Attorney, Agent, or Firm*—Donald Cayen

[57] ABSTRACT

A cartridge for binding multi-page documents comprises a center member and a pair of side members pivotally connected to the center member. In the closed operative configuration, the side and center members cooperate to form a U-shaped channel for receiving the documents. Pins extending between and supported by the side members enter aligned holes in the documents for suspending them. The side members are provided with a lock for releasably locking the cartridge in the closed configuration. The lock comprises a first tab on one side member having an opening therein and a second tab on the other side member having a protrusion. The two tabs cooperate such that the second tab protrusion releaseably engages the first tab opening when the cartridge is in the closed configuration. The cartridge may be made with a T-shaped bar or a center hook suspension system. A frictional coupling retains one side member to the center member in the closed configuration even though the second side member remains in the open configuration and the tab lock is inoperative.

23 Claims, 4 Drawing Sheets

DOCUMENT CARTRIDGE

BACKGROUND OF THE INVENTION

1. Field of the Invention

This invention pertains to document management, and more particularly to apparatus for storing multi-page printed documents.

2. Description of the Prior Art

Numerous products and systems have been developed to assist office personnel handle the flow of paper in an efficient manner. Of particular significance in modern offices is the filing and retrieval of such documents as control manuals, forms, and computer generated reports. Organized management of such media is essential if the work place is to avoid being overwhelmed by the information explosion.

One of the most important components of a media storage and retrieval system are holders for binding computer printouts. Examples of such document holders are shown in U.S. Pat. Nos. Des. 248,484; Des. 250,715; 4,056,296; and 4,171,854. Another type of document holder is marketed by Engineered Data Products of Denver, Colo., under the designation P/N 1220-XX.

Although the aforementioned holders are generally satisfactory for their intended purposes, they nevertheless suffer from certain disadvantages. For example, they are composed of several relatively complicated parts, and therefore are undesirably expensive. Opening and closing the Engineered Data Products holder requires a sequence of linear and pivoting motions of the major parts, thereby rendering them rather awkward to operate.

Thus, a need exists for an improved product for managing computer printouts.

SUMMARY OF THE INVENTION

In accordance with the present invention, a simple cartridge is provided that conveniently and efficiently binds and stores multi-page paper documents in a neat and portable fashion. This is accomplished by apparatus that includes a dual-hinged frame in combination with a couple of pins.

The cartridge frame is comprised of a center member formed as an elongated strip. To each longitudinal edge of the center member strip is pivotally connected a side member. Both side members are made primarily as simple strips having slightly shorter lengths than the center member. The two side members freely swing relative to the center member by means of respective living hinges. The three members cooperate to selectively place the frame in an open or in a closed configuration. In the open configuration, the planes of the two side member strips and the center member strip are generally parallel and approximately coplanar. In the closed configuration, the planes of the side strips are approximately perpendicular to the plane of the center member strip such that the frame acquires a generally U-shaped channel configuration.

To retain the two side members in the closed configuration, they are fastenable to each other with a releasable lock. The lock is comprised of a pair of cooperating tabs on both ends of the frame. A tab is joined to each end of both side members. Each tab extends perpendicular to the plane of the respective side member strip in the direction of side member pivoting motion toward the closed configuration. When in the closed configuration, the two tabs at each end of the frame overlap in close proximity to each other. To lock the overlapping tabs of each pair to each other, one tab of each pair is formed with an opening and the other tab of each pair is formed with a protrusion. In the closed configuration, the protrusions mate with the corresponding tab openings to lock the frame in place. The flexibility of the tabs permits easy intentional frame opening and closing, but the lock is designed with sufficient rigidity to secure the side and center members together against accidental opening.

To assist a person loading or removing paper from the cartridge of the present invention, at least one side member and the center member are formed with a snugly interfitting coupling. In one embodiment, the coupling comprises a pair of parallel lugs formed on the center member. The lugs are spaced to straddle a portion of a side member tab with a snug fit when that side member is in the closed configuration relative to the center member. The coupling serves to hold the side member to the center member in the closed configuration against gravity and gentle handling, but the coupling is easily released when intended.

To hold a sheaf of documents in the cartridge of the present invention, a pair of pins is inserted into suitable holes in one of the side members. The side member holes for receiving the pins are located so as to coincide with the standard mounting holes of several sizes of paper. The pins are inserted into the particular holes corresponding to the paper size to be stored. To align and hold the heavy papers, the other side member is fabricated with openings that securely receive the free ends of the pins. Preferably, the openings for receiving the pin free ends are formed with channels that guide the pin free ends into the supporting opening.

Further in accordance with the present invention, the center member strip may be constructed with alternate means for storing the cartridge. In one embodiment, the center member strip is formed with a center hook for hanging the cartridge from a horizontal rack. In a second embodiment, the cartridge is made with a longitudinally extending T-shaped support for sliding into an elongated channel in a storage rack.

Other advantages, benefits, and features will become apparent to persons skilled in the art upon reading the detailed description of the invention.

BRIEF DESCRIPTION OF THE DRAWINGS

FIG. 1 is a perspective view of the cartridge of the present invention in a closed operative configuration.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended thereto.

Referring to FIG. 1, a cartridge 1 is illustrated that includes the present invention. The cartridge 1 is especially useful for binding multiple sheets of paper 3 into a convenient and easy to store information system. More particularly, the cartridge is ideally suited for binding thick computer printouts.

Figures 2, 7:
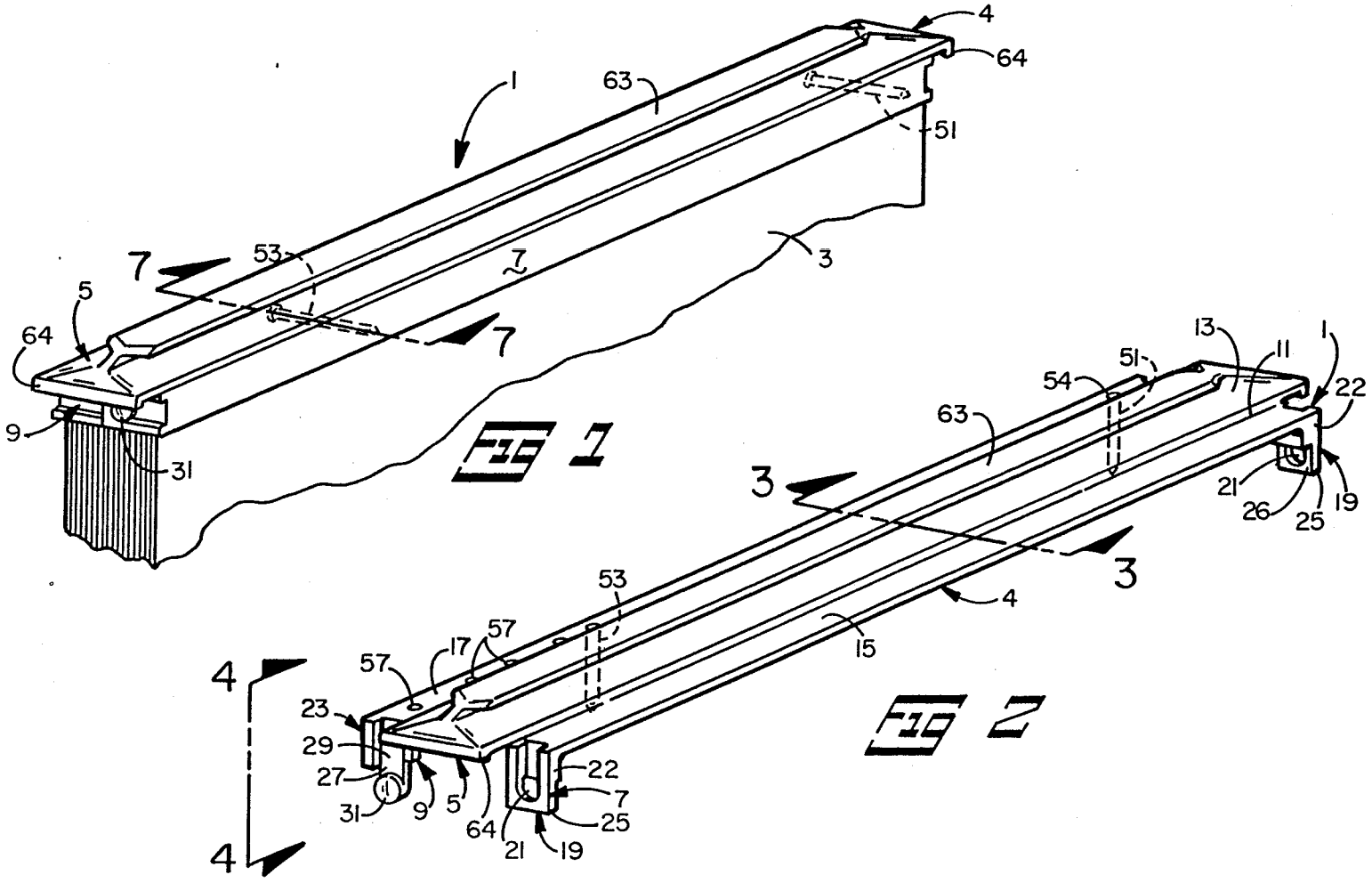
FIG. 2 is a perspective view of the cartridge of the present invention in an open inoperative configuration.
FIG. 7 is a partial cross sectional view taken along lines 7—7 of FIG. 1.
Figure 3:
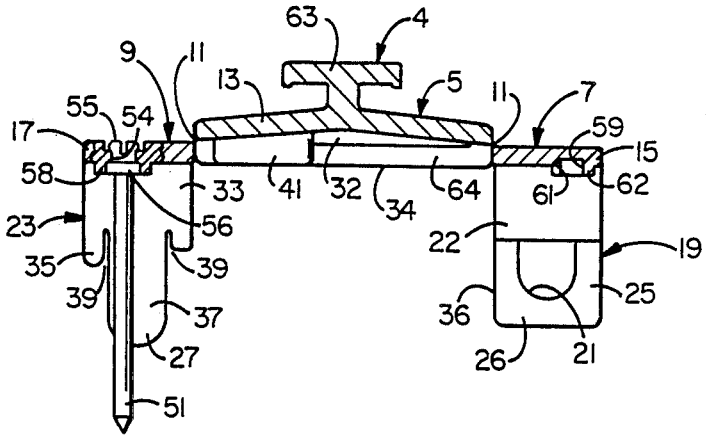
FIG. 3 is a cross sectional view, partially broken, taken along lines 3—3 of FIG. 2.
Figure 4:
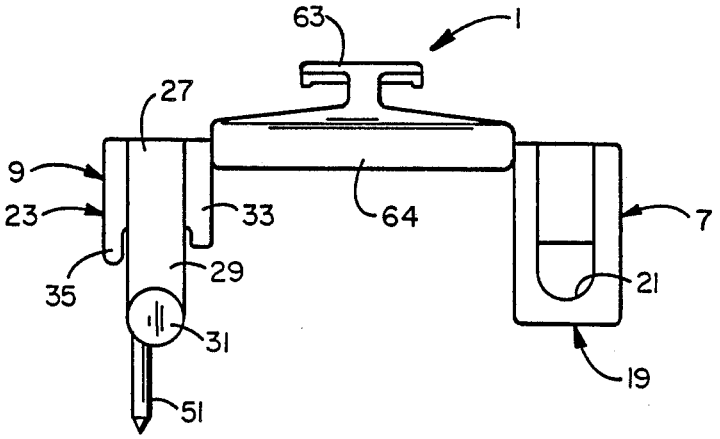
FIG. 4 is a view taken along lines 4—4 of FIG. 1.
Figure 5:
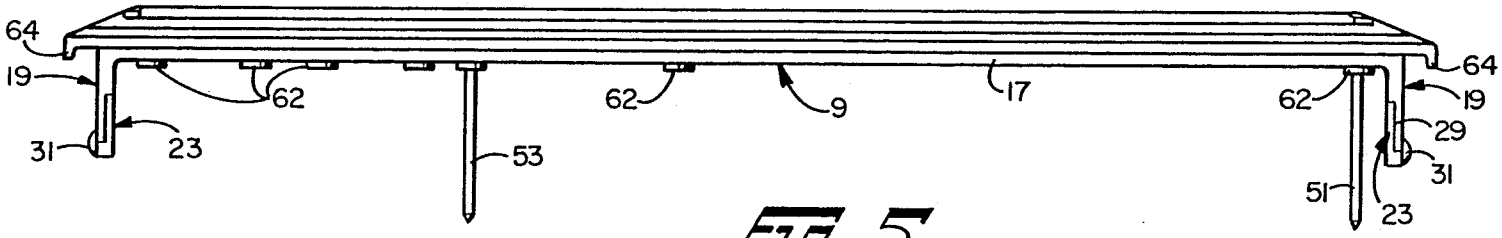
FIG. 5 is a back view of the cartridge of the present invention shown in the open configuration.
Figure 6:
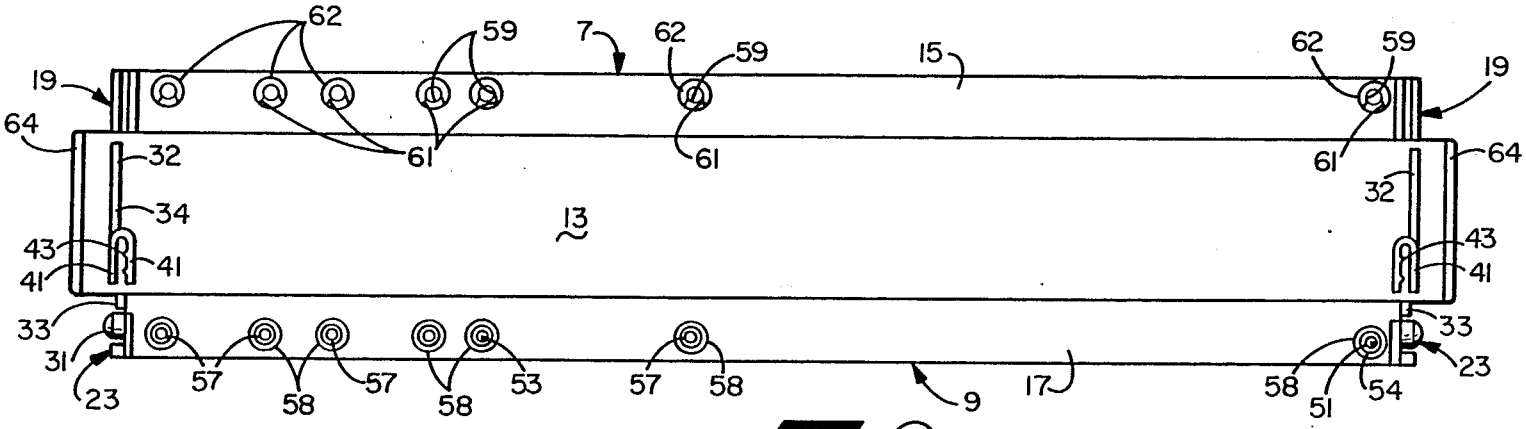
FIG. 6 is a bottom view of the cartridge of the present invention shown in the open configuration.

Referring also to FIGS. 2–6, the cartridge 1 is comprised of a frame 4 that includes an elongated center member 5 and a pair of side members 7 and 9. The side members 7 and 9 are pivotally joined along respective longitudinal edges to the opposed longitudinal edges of the center member 5. As best shown in FIGS. 3 and 6, pivotal joining of the center and side members is by living hinges 11. The side members are preferably slightly shorter in length than the center member.

In the construction illustrated in FIGS. 1–7, the frame center member 5 is formed with a center strip 13. The center strip 13 may be angled slightly in the transverse direction. The first side member 7 is comprised of a side strip 15 that is pivotally connected to the center member strip 13 by a living hinge 11. The side member 9 is comprised a side strip 17 that is also pivotally connected to the center member strip by a living hinge.

FIGS. 2–6 show the cartridge 1 in the open configuration that is inoperative for holding a sheaf of papers 3. In the open configuration, the side strips 15 and 17 of the side members 7 and 9, respectively, are approximately parallel with the center member strip 13. By means of the living hinges 11, the side members are pivotable to the closed operative configuration of FIGS. 1 and 7 wherein the side member strips are approximately perpendicular to the center member strip such that the side member and center strips form a generally U-shaped channel 10.

To retain the frame 4 in the closed configuration, both side members 7, 9 include respective parts that cooperate with parts on the other side member to form a releasable lock. Referring especially FIGS. 2–4 and 6, both ends of the side member 7 are formed with a female tab 19. The tab 19 extends approximately perpendicular to the plane of the side member strip 15. The tabs 19 are preferably constructed with relatively thick base sections 22 and thin free ends 25. The free ends 25 define inwardly facing surfaces 26. The tabs 19 have generally semicircular shaped openings 21 through the free ends 25.

Looking also at FIG. 5, both ends of the side member 9 are formed with tabs 23 that depend in a generally perpendicular fashion from the side member strip 17. In the preferred embodiment, each tab 23 is split into three sections. A middle section 27 has an outer facing surface 29 that is generally coplanar with the inside surface 26 of the associated female tab 19. Protruding from the outwardly facing surface 29 of the tabs middle section 27 is a partially spherical button 31. The locations of the buttons 31 and the openings 21 are chosen such that when the side members 7 and 9 are pivoted to the closed configuration of FIGS. 1 and 7, the buttons are aligned with and enter the openings.

Straddling the middle section 27 of each tab 23 are an inside section 33 and an outside section 35. The inside surfaces of the three sections 27, 33, and 35 may be generally coplanar, but the inside section 33 has an accurately controlled thickness, as will be explained fully hereinafter, that may place the inside surface thereof slightly out of plane with the inside surfaces of the other two sections. To provide bending flexibility to the middle section 27, narrow slits 39 are cut between the middle section 27 and the inside and outside sections. The flexible free ends 25 of the tabs 19 and of the middle sections 27 of the tabs 23 allow sufficient deflection of the tabs for the buttons 31 to pass over the inside facing surfaces 26 of the tabs 19 and to resiliently snap into the tab openings 21 when the frame 4 is closed to the operative configuration of FIGS. 1 and 7. As a result, the buttons and openings cooperate to retain the frame in the closed configuration.

To positively locate the side members 7 and 9 in the closed configuration, the frame 4 is fabricated with a pair of ribs 32. The ribs have respective locating surfaces 34 that abut the inside edges 36 of the tabs 19 to control the position of the tabs 19 in the closed configuration.

Opening the frame 4 is simply accomplished by depressing the two buttons 31 out of their respective openings 21 and pivoting the side members 7 and 9 away from each other about the hinges 11. Alternately, the two side members can be grasped between the thumb and forefinger of opposite hands and simultaneously pivoted away from each other about the hinges. The flexibility of the tabs 19 and 23 is such that the buttons and openings will then disengage to release the frame from the closed configuration.

It is a feature of the present invention that at least one side member 7 or 9 may be temporarily but snugly coupled in the closed configuration of FIGS. 1 and 7 by means other than the locking tabs 19 and 23. Referring to FIGS. 3, 6, and 7, it will be noticed that the inside of the center member strip 13 is formed with a pair of upstanding lugs 41 near each end. In FIG. 6, the lugs 41 of each pair are shown joined into a hairpin shape but such joining is not necessary for the functioning of the lugs. The spacing between the lugs of each pair is accurately controlled to snugly receive the inside section 33 of a tab 23 when that tab is pivoted to the closed configuration. To provide further gripping for the tab 23, one of the lugs of each pair may be formed with one or more projecting points 43 that bear against the inside surface of the tab inside section 33. For clarity, the points 43 are shown exaggerated in size. In that manner, the lugs and tab inside section 33 form a coupling such that the side member 9 can be pivoted about its living hinge 11 to the closed configuration and be retained thereat without having to pivot the other side member 7 to the closed configuration.

To hold the computer printout or other papers 3 in the cartridge 1 of the present invention, a pair of identical pins 51, 53 are inserted through the side strip of one of the side members 7 or 9. In FIGS. 2–4, 6, and 7, the pins 51 and 53 are shown inserted into the side member 9. A pin 51 is inserted into a through hole 54 near one end of the side member 9. The opposite end of the side member 9 defines several holes 57, which are substantially identical to the hole 54, for receiving the pin 53. Each pin has a split head 55 for easy insertion into the hole 54 or 57, together with an annular collar 56 for locating the pin in place. To provide additional material for securing the pins, the side member strip may be formed with bosses 58 surrounding the holes 54. The distance between the various holes 57 and the hole 54 are set to the standard hole spacings of various conventional paper sizes. The user selects the paper size to be used with the cartridge 1 and pin 51, and inserts a pin 53 into the appropriate hole 57. The other holes 57 remain empty.

In the side member 7 opposite each of the holes 54 and 57 is a blind hole 59. The holes 59 have lead-in tapered channels 61. The channels 61 and blind holes are partially defined by respective bosses 62. When the side members 7 and 9 are pivoted to the closed operative configuration of FIGS. 1 and 7, the free ends of the pins 51 and 53 slip smoothly through the tapered channels and into the blind holes, thereby enabling the pins to support the papers 3.

To store the cartridge 1 in a conventional storage cabinet or rack, the frame 4 is fabricated with an elongated T-shaped support 63. The various dimensions of the T-support 63 are chosen to permit the cartridge to slide easily within a cooperating channel in the cabinet or rack, not shown. Thus, the cartridge and papers 3 are supported by a member that extends parallel to the long dimension of the cartridge. To suspend the cartridge from a set of spaced parallel hanger bars placed perpendicular to the cartridge long dimension, each end of the frame 4 may be formed with a downwardly facing hook 64.

To use the cartridge 1 of the present invention, a person opens the side members 7 and 9 to the orientation shown in FIG. 6, with the T-section 63 against a table or desk top and with the pins 51 and 53 extending upwardly. She places the paper holes over the properly placed pins 51 and 53. She then folds the center member 5 to a vertical attitude such that the inside sections 33 of the tabs 23 enter between the corresponding lugs 41. The combination of the weight of the papers 3 and the friction between the tab inside section 33 and the lugs 41 retain the center member in a vertical plane. Finally, she gently pushes the side member 7 into a horizontal attitude parallel to the side member 9. The pin free ends enter the channels 61 and blind holes 59. Simultaneously, the buttons 31 of the tabs 23 enter the openings 21 of the tabs 19, thereby locking the cartridge in the closed operative configuration of FIGS. 1 and 7. The cartridge is then ready for efficient use and storage on a long term basis.

Figure 8:
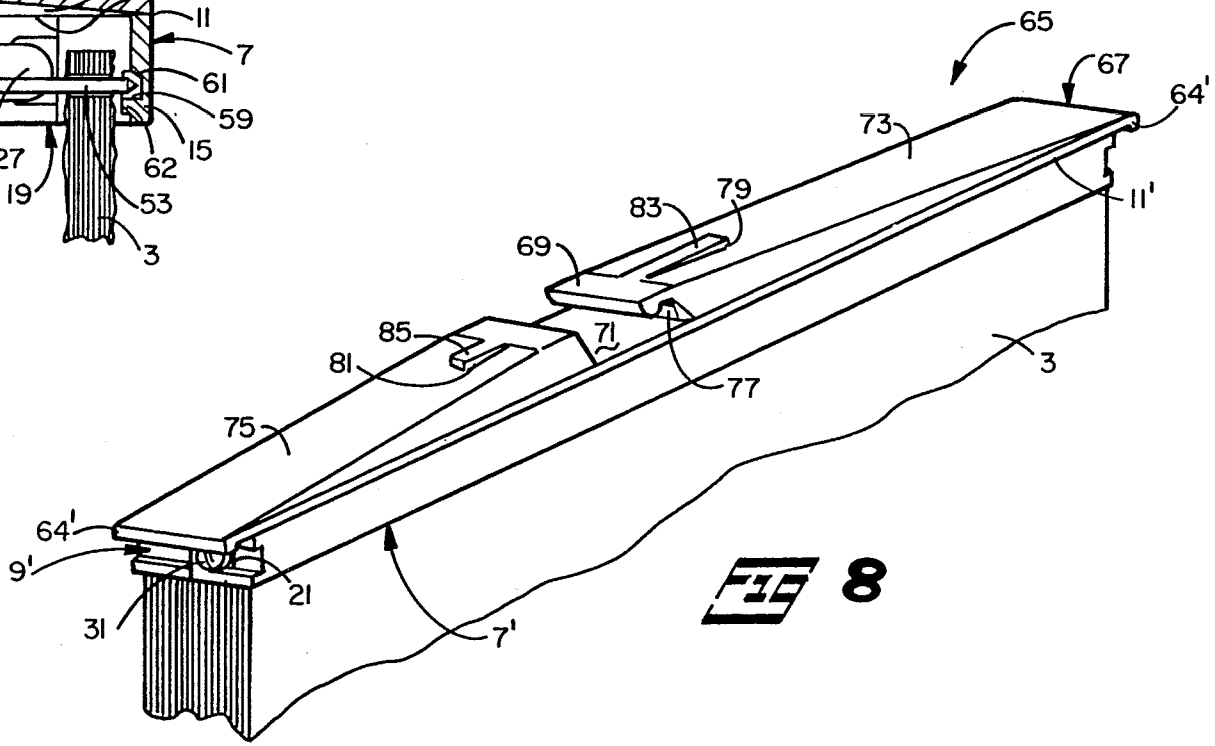
FIG. 8 is a perspective view of a modified embodiment of the present invention.
Figure 7:
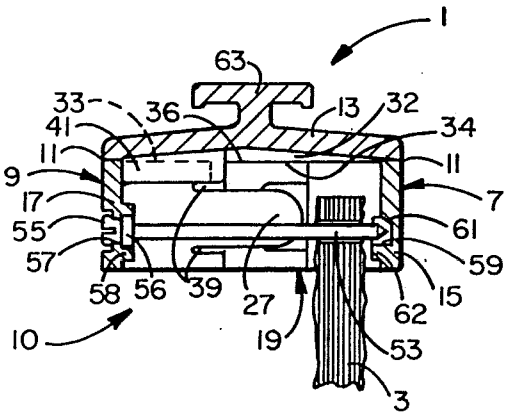

Turning to FIG. 8, a modified cartridge 65 is illustrated that embodies the present invention. The cartridge 65 comprises side members 7' and 9' that correspond in every way to the side members 7 and 9 described in connection with FIGS. 1–7. The cartridge 65 also includes an elongated center member 67 interposed between the two side members 7' and 9' and pivotally connected thereto with respective living hinges 11'. The modified cartridge 65 differs from the cartridge 1 of FIGS. 1–7 in the structure for storing the cartridge and bound papers 3. Instead of a longitudinally flat strip and a T-shaped support, the cartridge 65 is fabricated with a center strip 67 having two longitudinally tapered sections 73 and 75 separated by a flat lower section 71. Side walls 77 join the longitudinally tapered sections 73 and 75 to the flat lower section 71. A center hook 69 is joined to one of the longitudinally tapered sections and is spaced above the flat lower section 71. The center hook 69 is used for suspending the cartridge 65 from a sheet metal rack in known fashion. To prevent the cartridge 65 from rolling on its side, the tapered sections 73 and 75 are formed with respective ramps 79 and 81 having flat upper surfaces 83 and 85. The surfaces 83 and 85 lie in close proximity to the sheet metal rack for abutting the rack if the cartridge tends to roll. The center strip 67 also may be formed with end hooks 64' for supporting the cartridge and papers on spaced parallel bars, racks, or drawer sides.

Thus, it is apparent that there has been provided, in accordance with the invention, a cartridge holder that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A cartridge for binding a plurality of papers together comprising:

a. a frame comprising:

i. a flat elongated center strip having first and second longitudinal edges and opposed ends;

ii. a first elongated side member having a side strip pivotally joined to the center strip for pivoting between opened and closed configurations, the first side member having first tab means for defining an opening therethrough; and iii. a second elongated side member having a side strip pivotally joined to the center strip for pivoting between opened and closed configurations relative thereto, the second side member cooperating with the center strip and first side member to form a generally U-shaped channel for receiving the papers when in the closed configuration, the second side member having second tab means for cooperating with the first tab means to releasably lock the frame in the closed configuration; and b. pin means for holding the papers in the frame when the frame is in the closed configuration.

2. The cartridge of claim 1 wherein:

a. the first tab means comprises at least one first tab joined to one end of the first side member side strip and extending generally perpendicular therefrom; and b. the second tab means comprises at least one second tab joined to one end of the second side member side strip and extending generally perpendicular therefrom, the second tab defining a protrusion that resiliently enters the first tab opening when the frame is in the closed configuration to thereby releasably lock the frame in the closed configuration.

3. The cartridge of claim 1 wherein:

a. the pin means comprises at least two pins having respective first and second ends;

b. a selected one of the first and second side members defines means for releasably receiving the pin first ends at a selected predetermined spacing therebetween; and c. the second side member defines at least two holes having respective tapered channels leading thereto that guide the pin second ends into the respective holes as the side members are pivoted from the open to the closed configuration.

4. The cartridge of claim 1 further comprising coupling means for frictionally retaining at least one of the first and second side members to the center member in a closed configuration while the other of the first and second side members is in an open configuration.

5. The cartridge of claim 1 further comprising coupling means for frictionally retaining the second side member in the closed configuration with the center member while the first side member is in the open configuration.

6. The cartridge of claim 5 wherein the coupling means comprises:

a. at least one pair of parallel spaced lugs attached to the center member; and b. an inside section formed on the tab means of the second side member in alignment with the spacing between the lugs attached to the center member, the tab means inside section having a thickness substantially equal to the spacing between the lugs to thereby enable the inside section to be snugly received between the lugs on the center member.

7. A cartridge for binding a sheaf of papers comprising:

a. a unitary elongated generally flat center strip;

b. first and second side members having respective generally flat strips pivotally joined to the center strip along respective living hinges therebetween for pivoting between an open configuration wherein the planes of the center strip and the side member strips are approximately parallel and a closed configuration wherein the plane of the center strip is approximately perpendicular to the planes of the side member strips;

c. first and second tab means joined to the first and second side members, respectively, for cooperating with each other to releasably lock the first and second members in the closed configuration; and d. pin means inserted into one of the side members for being received by the other side member when the side members are in the closed configuration to thereby enable the pin means to support the papers.

8. The cartridge of claim 7 wherein:

a. the first tab means comprises at least one first tab joined to the first side member strip and extending perpendicular to the plane thereof, the first tab defining an opening therethrough; and b. the second tab means comprises at least one second tab joined to the second side member strip and extending perpendicular to the plane thereof, the second tab defining a protrusion for resiliently entering the first tab opening when the first and second side members are in the closed configuration to thereby releasably lock the first and second side members in the closed configuration.

9. The cartridge of claim 7 wherein:

a. the pin means comprises at least two pins, each pin having a first end releasably received in a selected one of the first and second side members, and a free end;

b. the other of the first and second side members defines a hole aligned with each pin and a tapered channel leading into the hole to guide the free end of the associated pin into the hole as the two side members are pivoted to the closed configuration.

10. The cartridge of claim 7 further comprising coupling means for frictionally retaining at least one of the first and second side members to the center strip in a closed configuration.

11. The cartridge of claim 10 wherein the coupling means comprises:

a. at least one pair of spaced lugs attached to the center strip; and b. a section formed in at least one of the first and second tab means for being snugly received in the center strip lugs to retain the tab means to the center strip in a closed configuration.

12. A cartridge for binding a sheaf of papers comprising:

a. a unitary elongated generally flat center strip;

b. first and second side members having respective generally flat strips and being pivotally joined to the center strip along respective living hinges therebetween for pivoting between an open configuration wherein the planes of the center strip and the side member strips are approximately parallel and a closed configuration wherein the plane of the center strip is approximately perpendicular to the planes of the side member strips;

c. lock means for releasably locking the first and second members in the closed configuration, wherein the lock means comprises:

i. at least one first tab joined to the first side member strip and extending perpendicular to the plane thereof, the first tab having an inside facing surface and defining an opening therethrough; and ii. at least one second tab joined to the second side member strip and extending perpendicular to the plane thereof, the second tab having an outside surface generally coplanar with the first tab inside surface, the second tab outside surface being formed with a protrusion that resiliently enters the opening in the first tab when the first and second side members are in the closed configuration to thereby releasably lock the cartridge in the closed configuration; and d. pin means inserted into at least one of the side members for being received by the other side member when the side members are in the closed configuration to thereby enable the pin means to support the papers.

13. The cartridge of claim 12 wherein the first and second tabs are joined to the first and second side members at the respective ends thereof.

14. A cartridge for binding a sheaf of papers comprising:

a. a unitary elongated generally flat center strip;

b. first and second side members having respective generally flat strips and being pivotally joined to the center strip along respective living hinges therebetween for pivoting between an open configuration wherein the planes of the center strip and the side member strips are approximately parallel and a closed configuration wherein the plane of the center strip is approximately perpendicular to the planes of the side member strips;

c. lock means for releasably locking the first and second members in the closed configuration, the lock means comprising first and second tab means joined to the first and second side members, respectively, for cooperating with each other to releasably lock the first and second side members in the closed configuration, the first tab means comprising at least one first tab joined to the first side member strip and extending perpendicular to the plane thereof, the first tab defining an opening therethrough, the second tab means comprising at least one second tab joined to the second side member strip and extending perpendicular to the plane thereof, the second tab defining a protrusion for resiliently entering the first tab opening when the first and second side members are in the closed configuration to thereby releasably lock the first and second side members in the closed configuration, wherein the second tab comprises:

i. a middle section having a free end, the protrusion being formed on the middle section free end; and ii. an inside section joined to and lying adjacent the middle section, the middle and inside sections being separated by a slit of predetermined length to thereby enhance the flexibility of the middle section free end; and d. pin means inserted into at least one of the side members for being received by the other side member when the side members are in the closed configuration to thereby enable the pin means to support the papers.

15. The cartridge of claim 14 further comprising coupling means for releasably retaining the second side member to the center strip in a closed configuration when the first side member is an open configuration and the lock means is inoperative.

16. The cartridge of claim 15 wherein the coupling means comprises:

a. surface means formed on the center strip and defining an opening therebetween; and b. the inside section of the second side member tab, the second tab inside section being located on the second side member to enter the opening between the center strip surface means for being frictionally retained therebetween when the second side member is in the closed configuration.

17. The cartridge of claim 16 wherein the surface means comprises point means attached thereto for bearing against the second tab inside section to enhance frictional contact therebetween.

18. A cartridge for binding selected data media comprising: p1 a. an elongated center member having opposed longitudinal edges;

b. a first side member comprising:

i. a longitudinally extending strip joined by a living hinge to one center member longitudinal edge and having opposed ends, the first side member being pivotable between an open configuration wherein the strip is approximately parallel to the center member and a closed configuration wherein the strip is perpendicular to the center member; and ii. at least one tab attached to an end of the strip and extending perpendicular therefrom, the tab having a free end that defines an opening therethrough;

c. a second side member comprising:

i. an elongated strip joined by a living hinge to the other center member longitudinal edge and having opposed ends, the second side member being pivotable between an open configuration wherein the strip is generally parallel to the center member and a closed configuration wherein the strip is generally perpendicular to the center member; and ii. at least one tab attached to an end of the strip and extending perpendicular therefrom, the tab having a free end that defines a protrusion that resiliently enters the opening in the tab of the first side member when the first and second side members are in the closed configuration to thereby lock the first and second side members into the closed configuration; and d. pin means for suspending the data media between the first and second side members.

19. The cartridge of claim 18 further comprising coupling means for frictionally retaining at least the second side member to the center member in the closed configuration while the first side member remains in the open configuration.

20. The cartridge of claim 18 wherein the center member defines surface means for frictionally engaging the second side member tab to snugly retain the second side member to the center member in the closed configuration while the first side member remains in the open configuration.

21. The cartridge of claim 18 wherein:

a. the pin means comprises a plurality of pins having first ends releasably inserted into a selected one of the first and second side members and free ends; and b. the other of the first and second side members is formed with a plurality of openings for receiving the pin free ends, the openings being formed with lead-in channels for guiding the pin free ends to the openings when the side members are pivoted to the closed configuration.

22. A method of binding a sheaf of documents comprising the steps of:

a. providing a cartridge having an elongated center member and first and second side members attached by respective living hinges to the center member, the side members defining respective interlocking tabs;

b. inserting a pair of pins into the first side member with a selected spacing therebetween;

c. opening the cartridge so that the center and side members are approximately parallel and coplanar;

d. placing the documents over the pins;

e. pivoting the center member such that it is approximately perpendicular to the first side member; and f. pivoting the second side member so that it is perpendicular to the center member; and g. engaging the side member interlocking tabs to thereby retain the first and second side members perpendicular to the center member.

23. The method of claim 22 wherein the step of pivoting the center member so that it is approximately perpendicular to the first side member includes the step of frictionally retaining the center member to the first side member while perpendicular thereto.

* * * * *